US005593356A

United States Patent [19]

Takeda

[11] Patent Number: 5,593,356

[45] Date of Patent: Jan. 14, 1997

[54] GOLF CLUB HEAD WITH PERIPHERAL WEIGHTS

[75] Inventor: Hitoshi Takeda, Tsubame, Japan

[73] Assignee: K.K. Endo Seisakusho, Japan

[21] Appl. No.: 586,294

[22] Filed: Jan. 16, 1996

Related U.S. Application Data

[62] Division of Ser. No. 250,431, May 27, 1994, Pat. No. 5,564,705.

[30] Foreign Application Priority Data

| | | | |
|---|---|---|---|
| May 31, 1993 | [JP] | Japan | 5-129627 |
| Jul. 22, 1993 | [JP] | Japan | 5-181685 |
| Oct. 4, 1993 | [JP] | Japan | 5-248195 |
| Mar. 30, 1994 | [JP] | Japan | 6-61178 |

[51] Int. Cl.[6] ..... A63B 53/04

[52] U.S. Cl. ..... 473/335

[58] Field of Search ..... 473/334, 335, 473/336, 338, 339, 349, 350

[56] References Cited

U.S. PATENT DOCUMENTS

| | | | |
|---|---|---|---|
| 1,504,380 | 8/1924 | Reitenour | 473/325 |
| 1,538,312 | 5/1925 | Beat | 473/337 |
| 3,250,536 | 5/1966 | Moser | 473/349 |
| 3,847,399 | 11/1974 | Raymont | 473/350 |
| 3,955,820 | 5/1976 | Cochran et al. | 473/337 |
| 4,213,613 | 7/1980 | Nygren | 473/337 X |
| 4,919,431 | 4/1990 | Antonious | 473/350 |
| 5,209,473 | 5/1993 | Fisher | 473/335 X |
| 5,419,560 | 5/1995 | Bamber | 473/350 |
| 5,439,223 | 8/1995 | Kobayashi | 473/334 |

FOREIGN PATENT DOCUMENTS

| | | | |
|---|---|---|---|
| 1232651 | 5/1971 | United Kingdom | 273/171 |

*Primary Examiner*—William H. Grieb
*Attorney, Agent, or Firm*—Quarles & Brady

[57] ABSTRACT

An iron or putter golf club head having a larger sweet area and the lowered center of gravity. A head body 11*a* made of pure titanium or titanium alloy is provided with three separate weights such as a back weight 12*a*, a face weight 13*a* and a sole weight 14*a*. The back weight 12*a* is annular, being positioned along a peripheral portion of a back 2*a* side. The face weight 13*a* is semi-annular, being positioned along the face la side except a top 4*a* side. The sole weight 14*a* is widened at its toe and heel side. Thus, the weight distribution of the head is greatly concentrated on the peripheral portion thereof to enlarge a sweet area. Particularly, the center of gravity of the head can be lowered owing to the sole weight 14*a*.

6 Claims, 4 Drawing Sheets

GOLF CLUB HEAD WITH PERIPHERAL WEIGHTS

CROSS REFERENCE TO RELATED APPLICATIONS

This application is a divisional application of U.S. Ser. No. 08/250,431, filed May 27, 1996 now U.S. Pat. No. 5,564,705.

BACKGROUND OF THE INVENTION (a) Field of the Invention

The present invention relates to a golf club head, especially relates to so-called an iron golf club head or a putter golf club head.

(b) Description of Prior Art

Golf club head generally comprises a face for striking balls, a back, a sole, a top, a heel and a neck for mounting a shaft thereto. Conventional golf club heads such as iron heads or putter heads have had the above-mentioned parts integrally formed of metallic material such as iron by forging. However, such integrally formed heads have been liable to cause a sense of unstability in swinging, and generally had narrower sweet area. What is called sweet area is a certain area on face where golf balls are capable of travelling more straight and a longer distance when they are struck. It is widely recognized that to enlarge a sweet area, the center of gravity of the whole club head should be positioned backward, and/or, the weight distribution of the head should be concentrated on a peripheral portion relative to the face.

On the other hand, it is mainly for the purpose of making a golf ball travel more upwardly and a longer distance to lower the center of gravity of a club head. One of the representative of a means for realizing such weight distribution is disclosed in U.S. Pat. No. 3,847,399, in which a head body is formed hollow, or a back surface of a club head is formed with a cavity.

However, especially for an iron club head, it is difficult to make the same hollow. Further, only a cavity formed in a back surface of a club head made of a single material cannot sufficiently concentrate the weight distribution of a club head upon a peripheral portion, thus setting limits to enlargement of a sweet area.

SUMMARY OF THE INVENTION

It is, therefore, an object of the present invention to further enlarge a sweet area in a golf club head such as an iron golf club head.

It is another object of the present invention to further lower the center of gravity of a golf club head such as an iron golf club head.

It is also an object of the present invention to provide a golf club head which is suitable for a player having slicing tendencies.

It is further an object of the present invention to provide a golf club head which is suitable for a player having hooking tendencies.

According to a major feature of the present invention, a golf club head comprising: a head body defined by a face, a back, a top, a sole, a toe, a heel and a neck; three separate balance weights each being denser than the head body, comprising: a first balance weight which is annular and provided along a peripheral portion of the head body at the back side; a second balance weight which is semi-annular and provided along a peripheral portion of the head body at the face side, said second balance weight extending along the toe, sole and heel side only; a third balance weight provided in the sole of the head body.

BRIEF DESCRIPTION OF THE DRAWINGS

Other objects, features and advantages of the invention will be apparent to those skilled in the art from the following description of the preferred embodiments of the invention, wherein reference is made to the accompanying drawings, of which.

DETAILED DESCRIPTION OF THE PREFERRED EMBODIMENTS

Figure 1:
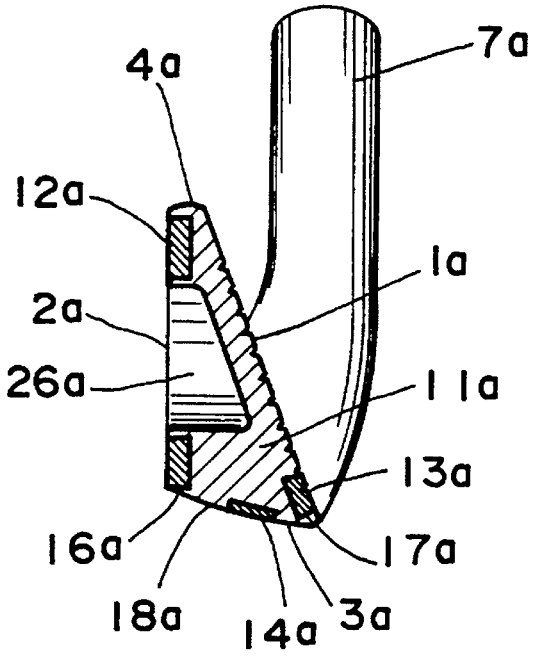
FIG. 1 is a sectional view showing a first embodiment of a golf club head of the invention, which is taken on A—A line of FIG. 2.
Figure 2:
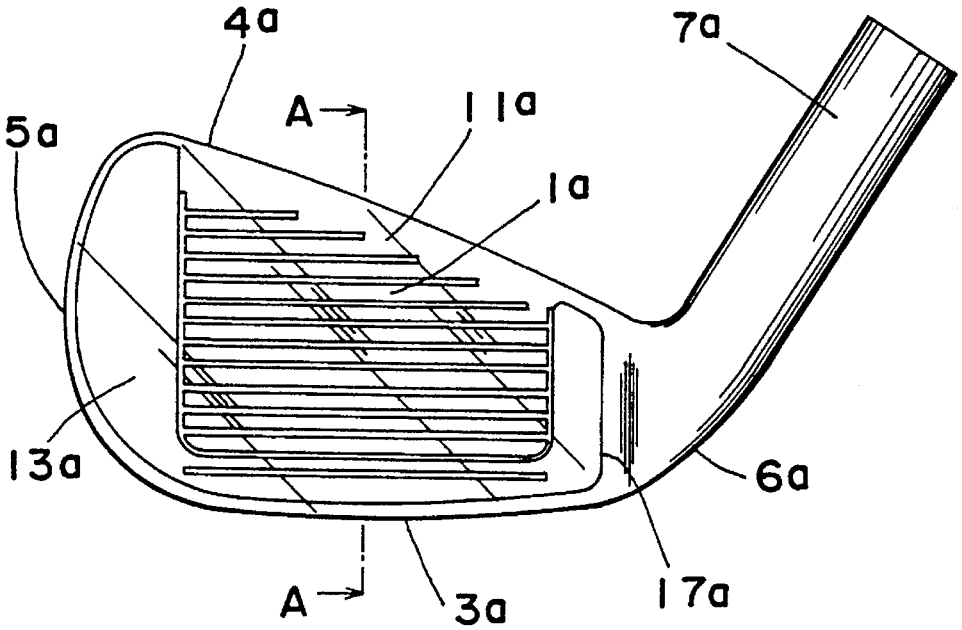
FIG. 2 is a front view showing a first embodiment of a golf club head of the invention.
Figure 3:
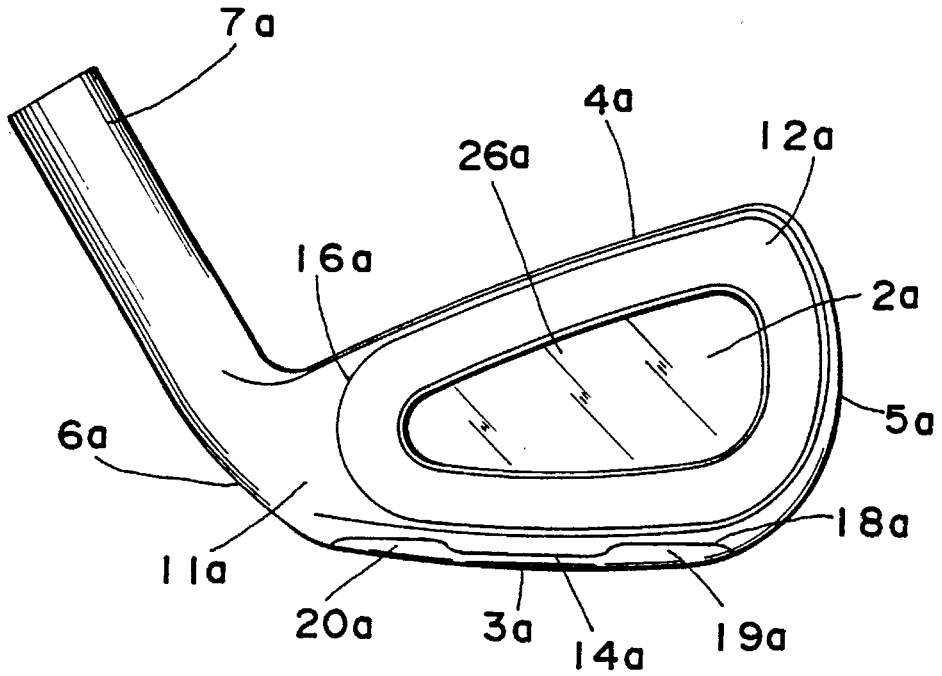
FIG. 3 is a rear view showing a first embodiment of a golf club head of the invention.
Figure 4:
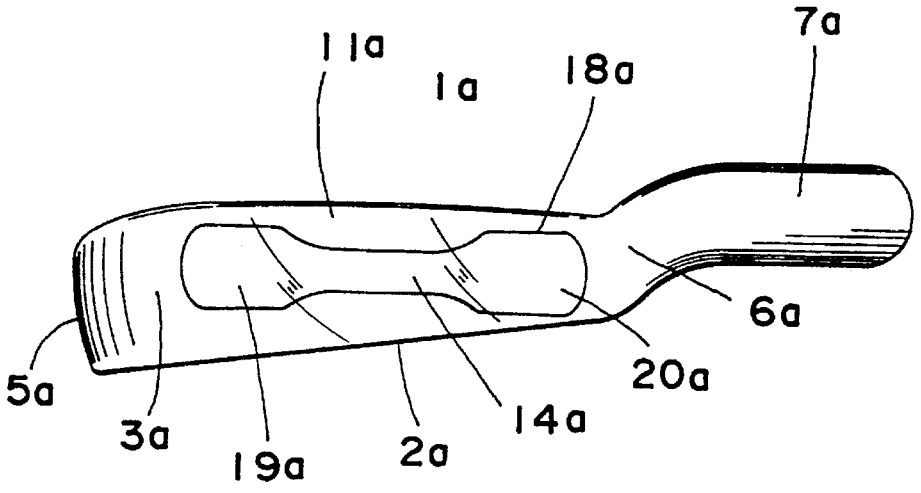
FIG. 4 is a bottom plan view showing a first embodiment of a golf club head of the invention.

In FIGS. 1 to 4 showing a first embodiment of the invention, there is provide an iron-type golf club head. Reference numeral 1*a* designates a front face, 2*a* a back, 3*a* a sole, 4*a* a top, 5*a* a toe at one side, 6*a* a heel at the other side and 7*a* a neck for connecting a shaft thereto.

In a preferred form of the invention, a golf club head of the invention comprises a head body 11*a*, a back weight 12*a*, a front weight 13*a* and a sole weight 14*a*, each being separate from the head body 11*a*. The head body 11*a* is made of pure titanium or titanium alloy (the specific gravity approx.4.5), forming a major part of the golf club head including said neck 7*a*. Whilst, said balance weights 12*a*, 13*a* and 14*a* are each made of beryllium copper alloy (the specific gravity approx.8.2), with the front weight 13*a* forming a part of said face 1*a*, the back weight 12*a* a part of said back 2*a* and the sole weight 14*a* a part of said sole 3*a* respectively.

Along a peripheral portion at the back 2*a* side of the head body 11*a* is provided an annular embedding groove 16*a*. The embedding groove 16*a* is dovetail-shaped, tapering in the front-to-back direction. Into the embedding groove 16*a* is press-fitted the annular back weight 12*a*.

On the other hand, along a peripheral portion at the front 1*a* side of the head body 11*a* is provided an annular embedding groove 17*a*. The embedding groove 17*a* is approximately U-shaped, being positioned along toe 5*a*, sole 3*a* and heel 6*a* side only, not along top 4*a* side, tapering in the back-to-front direction. Into the embedding groove 17*a* is press-fitted the annular face weight 13*a*, approximately U-shaped, corresponding to the embedding groove 17*a*.

Additionally, along a peripheral portion at the sole 3*a* side of the head body 11*a* is provided an approximately straight embedding groove 18*a*, which tapers in the top-to-sole direction. Into the embedding groove 18*a* is press-fitted the annular sole weight 14*a*, approximately straightened, corresponding to the embedding groove 18*a*. The sole weight 14*a* is widened or thickened at the toe 5*a* side and heel 6*a* side than at an intermediate portion thereof, which widened portions being designated 19*a* and 20*a* respectively. Incidentally, an area surrounded by the annular back weight 12*a* is formed with a cavity 26*a* at the back 2*a* side of the head body 11*a*.

Now the method for manufacturing the above-structured golf club head will be described.

The head body 11*a* is basically formed by forging process, and either at the same time or after that, the embedding grooves 16*a*, 17*a* and 18*a* are each formed by machining. In the same manner, the weights 12*a*, 13*a* and 14*a* are each formed by forging. Then, the back weight 12*a* is cold pressed into the embedding groove 16*a* at the back 2*a* side of the head body 11*a*, the face weight 13*a* cold pressed into the embedding groove 17*a* at the face 1*a* side of the head body 11, and the sole weight 14*a* cold pressed into the embedding groove 18*a* at the sole 3*a* side of the head body 11*a* respectively. During such cold press-in process, the distal ends of the weights 12*a*, 13*a* and 4*a* are each subjected to a plastic deformation, thus being fitted into the respective embedding grooves 16*a*, 17*a* and 18*a* to be fixed there by mortise/tennon joint. After the above press-in of the back weight 12*a*, a cavity 26*a* is formed by milling with the use of a machining center.

With the structure shown in a first embodiment, as the denser back weight 12*a*, face weight 13*a* and sole weight 14*a* are each embedded into the peripheral portions at the back 2*a* , face 1*a* and sole 3*a* side of the head body 11*a* respectively, having the cavity 26*a* provided in the center of the back 2*a* side of the head body 11*a* , the weight distribution of a club head can be more concentrated upon the peripheral portion relative to the face 1*a* though a weight of the whole club head is kept within a regular value. Accordingly, the sweet area can be greatly enlarged, whereby balls will be able to travel more steadily and straight when struck in a wider area on the face 1*a*. In addition, specifically owing to the sole weight 14*a*, the center of gravity can be effectively lowered, whereby the balls will be able to be struck more easily upward, travelling a longer distance and more steadily. As a result, you can get a golf club head with which balls will be more easily controlled.

In the meanwhile, a typical iron golf club head is formed thicker sole 3*a* side than at top 4*a* side, which eventually makes it difficult to provide both a fully thickened back weight 12*a* and a face weight 13*a* at top 4*a* side. Therefore, in the preferred embodiment of the invention, the head body 11*a* is provided at top 4*a* side with the back weight 12*a* only, thus positioning the center of gravity of the whole head stil backwards (i.e., enlarging the C.G. depth) to effectively enlarge a sweet area.

Whilst, in a preferred form of the invention, the sole weight 14*a* is relatively widened at toe 5*a* and heel 6*a* side, whereby the weight distribution can be effectively allotted to toe 5*a* and heel 6*a* sides respectively, thereby further enlarging a sweet area. In addition, the sole weight 14*a* is separately provided relative to the back weight 12*a* and face weight 13*a*, thus enabling the more freely choosing of the configuration of the sole weight 14*a* in manufacturing. For example, the separate sole weight may be provided with the widened portions 19*a* and 20*a* at toe 5*a* and heel 6*a* side respectively like a first embodiment, or may be provided with a widened portion 19*b* at toe 5*b* side only in a hereinbelow described second embodiment illustrated in FIG. 5, otherwise may be provided with a widened portion 20*c* at heel 6*c* side only in a hereinafter described third embodiment illustrated in FIG. 6.

Figure 5:
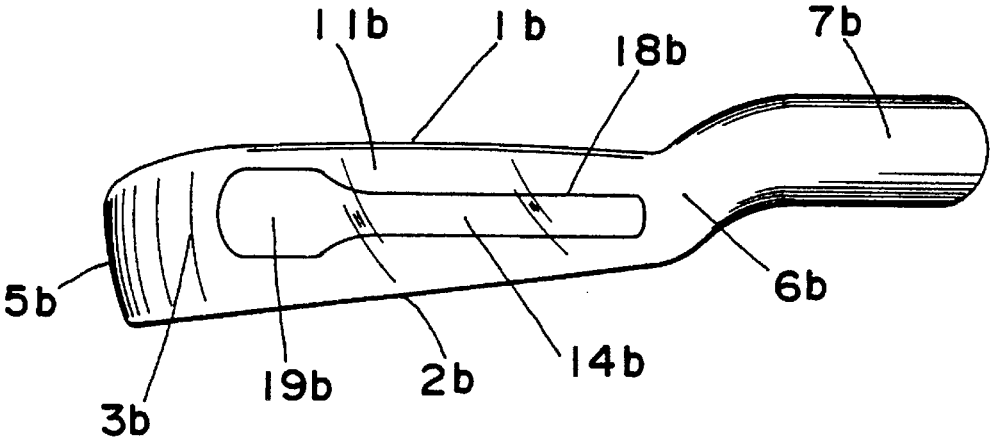
FIG. 5 is a bottom plan view showing a second embodiment of a golf club head of the invention.
Figure 6:
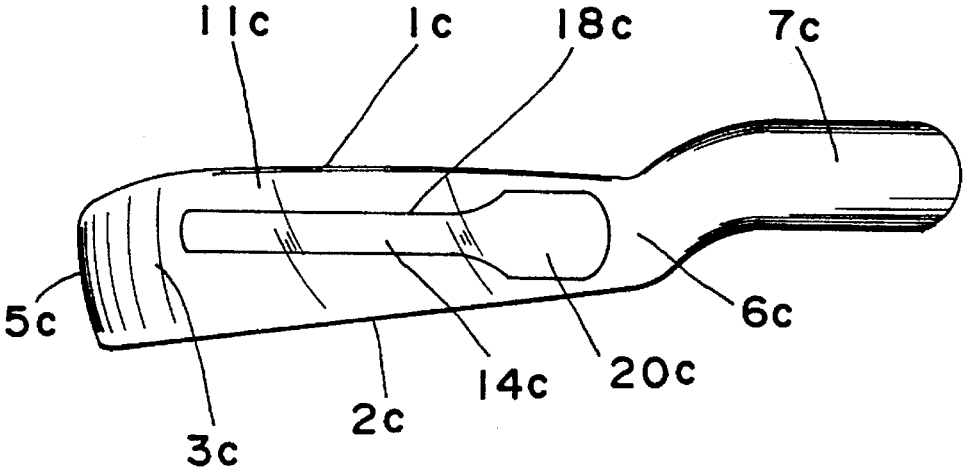
FIG. 6 is a bottom plan view showing a third embodiment of a golf club head of the invention.

Namely, in FIG. 5 showing a second embodiment, a sole weight 14*b* is widened at toe 5*b* side relative to at heel 6*b* side in order to shift the weight distribution of the head to the toe 5*b* side, thus supplying a golf player having a slicing tendency with a suitable golf club head. On the other hand, in FIG. 6 showing a third embodiment, a sole weight 14*c* is widened at heel 6*c* side relative to at toe 5*c* side in order to shift the weight distribution of the head to the heel 6*c* side, thus supplying a golf player having a hooking tendency with a suitable golf club head.

Figure 7:
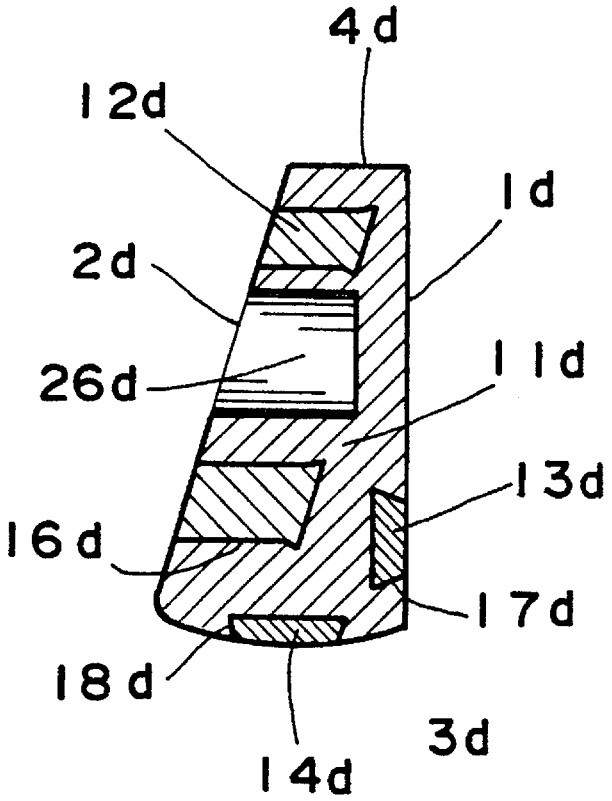
FIG. 7 is a sectional view showing a fourth embodiment of a golf club head of the invention.

Incidentally, the present invention should not be limited to the forgoing embodiments, but may be modified within a scope of the invention. For example, though the foregoing embodiments are all related to an iron type golf club head, the same structures may be applied to a putter type golf club head, as illustrated in FIG. 7 as a fourth embodiment. Further, the material of the head body and weights should not be limited to the foregoing. For example, the material of the head body may be other metallic material such as aluminium alloy than pure titainium or titanium alloy. Furthermore, the material of the weights may be comparatively denser metallic material such as copper alloy or stainless steel (the specific gravity approx. 7.9) other than beryllium copper alloy. In addition, like the sole weight, the back weight and the face weight may be provided with suitable widened portions, thus effectively preventing the slicing or hooking tendencies.

What is claimed:

1. A golf club head comprising:

a head body defined by a face, a back, a tip, a sole, a toe, a heel and a neck;

three separate balance weights each being denser than the head body comprising: a first balance weight which is annular and provided along a peripheral portion of the head body at the back side; a second balance weight which s semi-annular and provided along a peripheral portion of the head body at the face side, said second balance weight extending along the toe, sole and heel sides only; a third balance weight provided in the sole of the head body, wherein said third balance weight is widened at least at one of its toe side and heel side.

2. A golf club head according to claim 1, wherein said third balance weight is widened at its toe and heel sides relative to its intermediate portion.

3. A golf club head according to claim 1, wherein said third balance weight is widened at its toe side relative to its heel side.

4. A golf club head according to claim 1, wherein said third balance weight is widened at its heel side relative to its toe side.

5. A golf club head according to claim 1, wherein said third balance weight is elongated in the heel-to-toe direction of the sole.

6. A golf club head comprising:

a head body defined by a face, a back, a top, a sole, a toe, a heel and a neck, three separate balance weights each being denser than the head body comprising: a first balance weight which is annular and provided along a peripheral portion of the head body at the back side; a second balance weight which is semi-annular and provided along a peripheral portion of the head body at the face side, said second balance weight extending along the toe, sole and heel sides only; a third balance weight provided in the sole of the head body;

three embedding grooves provided in said head body, corresponding to said three separate balance weights, said three embedding grooves being dovetail-shaped, into which are press-fitted said three separate balance weights respectively.

* * * * *